US012571111B2

(12) United States Patent
Choi et al.

(10) Patent No.: US 12,571,111 B2
(45) Date of Patent: Mar. 10, 2026

(54) ELECTROLYTE CIRCULATION-BASED SODIUM HYPOCHLORITE GENERATOR WITH AUTOMATIC ELECTROLYTIC CELL CLEANING FUNCTION

(71) Applicant: JTECHWATER CO., LTD., Busan (KR)

(72) Inventors: Yuni Choi, Daegu (KR); Donghyoung Kim, Daegu (KR); Yohan Choi, Busan (KR); Nayeong Kim, Daegu (KR); Kwangyu Kim, Yeongju-si (KR)

(73) Assignee: JTECHWATER CO., LTD., Busan (KR)

( * ) Notice: Subject to any disclaimer, the term of this patent is extended or adjusted under 35 U.S.C. 154(b) by 573 days.

(21) Appl. No.: 18/087,283

(22) Filed: Dec. 22, 2022

(65) Prior Publication Data

US 2024/0209519 A1 Jun. 27, 2024

(30) Foreign Application Priority Data

Dec. 21, 2022 (KR) ..... 10-2022-0180799

(51) Int. Cl.
*C25B 1/22* (2006.01)
*C25B 1/26* (2006.01)
(Continued)

(52) U.S. Cl.
CPC ..... *C25B 1/22* (2013.01); *C25B 1/26* (2013.01); *C25B 9/15* (2021.01); *C25B 15/02* (2013.01); *C25B 15/08* (2013.01)

(58) Field of Classification Search
CPC ..... C25B 1/26; C02F 2201/46185; C02F 2201/4611; C02F 2301/028; C02F 2201/46145
See application file for complete search history.

(56) References Cited

U.S. PATENT DOCUMENTS 4,085,014 A * 4/1978 Bennett ..... C25B 15/00 205/536
4,107,024 A * 8/1978 Fukuzuka ..... C02F 1/46109 204/280

(Continued)

FOREIGN PATENT DOCUMENTS

KR 20-0397851 Y1 10/2005
KR 10-1110626 B1 2/2012

(Continued)

*Primary Examiner* — Harry D Wilkins, III
(74) *Attorney, Agent, or Firm* — Bridgeway IP Law Group, PLLC; Jihun Kim

(57) ABSTRACT

Proposed is an apparatus for generating sodium hypochlorite by electrolysis of brine such as seawater. More particularly, proposed is an electrolyte circulation-based sodium hypochlorite generator with an automatic electrolytic cell cleaning function, the generator being capable of controlling a flow path of an electrolyte, thereby increasing electrolysis efficiency and preventing deposition of hydroxides present in the electrolytic cell. The proposed generator can improve the electrolysis efficiency and minimize deposition of hydroxides by controlling a flow path of the electrolytic cell. In addition, deposits present in the electrolytic cell can be automatically cleaned and removed in real time by circulating electrolyzed water generated in the electrolytic cell without requiring the need for a separate cleaning process or complicated equipment.

8 Claims, 7 Drawing Sheets

(51) Int. Cl.

| | |
|---|---|
| ***C25B 9/15*** | (2021.01) |
| ***C25B 15/02*** | (2021.01) |
| ***C25B 15/08*** | (2006.01) |

(56) References Cited

U.S. PATENT DOCUMENTS

| | | | | | |
|---|---|---|---|---|---|
| 4,121,991 | A * | 10/1978 | Miller | C02F 1/46104 | 204/260 |
| 4,248,690 | A * | 2/1981 | Conkling | C25B 9/70 | 204/268 |
| 4,249,596 | A * | 2/1981 | Tutak | B01D 5/0036 | 165/113 |
| 4,372,827 | A * | 2/1983 | Spaziante | C25B 11/036 | 205/616 |
| 5,425,858 | A * | 6/1995 | Farmer | B01J 49/30 | 204/647 |
| 6,805,787 | B2 * | 10/2004 | Bess | C25B 1/26 | 205/474 |
| 2007/0007145 | A1 * | 1/2007 | Simmons | C25B 9/75 | 205/357 |
| 2015/0233003 | A1 * | 8/2015 | Righetti | C02F 1/4602 | 205/350 |

FOREIGN PATENT DOCUMENTS

| | | | | |
|---|---|---|---|---|
| KR | 10-1585304 | B1 | 7/2013 | |
| KR | 10-1714587 | B1 | 3/2017 | |
| WO | WO-2016064014 | A1 * | 4/2016 | B63J 4/00 |

* cited by examiner

ELECTROLYTE CIRCULATION-BASED SODIUM HYPOCHLORITE GENERATOR WITH AUTOMATIC ELECTROLYTIC CELL CLEANING FUNCTION

CROSS REFERENCE TO RELATED APPLICATION

The present application claims priority to Korean Patent Application No. 10-2022-0180799, filed Dec. 21, 2022, the entire contents of which is incorporated herein for all purposes by this reference.

BACKGROUND OF THE INVENTION

Field of the Invention

The present disclosure relates generally to an apparatus for generating sodium hypochlorite by electrolysis of brine, such as seawater. More particularly, the present disclosure relates to an electrolyte circulation-based sodium hypochlorite generator with an automatic electrolytic cell cleaning function, the generator being capable of controlling a flow path of an electrolyte, thereby increasing electrolysis efficiency and preventing deposition of hydroxides present in the electrolytic cell.

The present disclosure was supported by the following project sponsored by the Ministry of Environment of the Republic of Korea.

[Government Department] Ministry of Environment

[Research Management (Specialized) Institution] Korea Environmental Industry and Technology Institute

[Project Name] Green Innovative Company Growth Support Program

[Research Title] Commercialization of Next-Generation Anti-Chlorine Disinfection Equipment That Emits No Harmful Substances Using Electrode No-Clean Technology

[Contribution Ratio] 1/1

[Research Institution] J-Tech Water Co., Ltd.

[Research Period] From May 1, 2021 to Dec. 31, 2023

Description of the Related Art

In general, an electrolytic cell refers to a device for generating sodium hypochlorite (NaOCl) through electrolysis of seawater, brine, or a solution containing an electrolyte, or for metal recovery or water treatment through electrolysis.

Power plants are usually located on coasts where supply of water for condensate cooling in a condenser is free. After the high-temperature and high-pressure steam generated in a steam boiler turns a turbine, seawater is used as cooling water to cool the waste steam and convert it back to a liquid phase. However, since seawater contains marine organisms such as various shellfish and microorganisms, a kind of pretreatment process is required to use seawater as cooling water. To meet this, a method of killing marine organisms in seawater by producing sodium hypochlorite (NaOCl) through electrolysis of seawater has been widely adopted.

Thus, the electrolytic cell for producing sodium hypochlorite (NaOCl) is mainly used for the purpose of producing industrial sodium hypochlorite (NaOCl) by electrolysis of seawater, and then injecting it into a cooling system of a large-scale plant such as a power plant, steel mill, or petrochemical plant, thereby preventing growth and attachment of shellfish and microorganisms.

The electrolytic cell is designed so that sodium hypochlorite (NaOCl) can be produced as sodium chloride (NaCl) contained in seawater or brine is electrolyzed by applying direct current power to each of an anode and a cathode. Here, sodium hypochlorite (NaOCl) is produced at the anode, while magnesium oxide and calcium hydroxide are produced at the cathode by side reactions. Such magnesium oxide and calcium hydroxide generated at the cathode tend to adhere to the electrode and grow as scale which reduces the efficiency of the electrolytic cell. In order to remove this scale, it is necessary to periodically stop the operation of the electrolytic cell and perform cleaning with acid, which is a very cumbersome process.

Meanwhile, during the operation for producing high-concentration sodium hypochlorite (NaOCl) using a conventional electrolytic cell, there are disadvantages of temperature over-rising, excessive generation and growth of scale, and consequent deterioration in operating efficiency. In particular, a large volume of seawater is supplied at a high flow velocity by a booster pump or the like and passes through the electrolytic cell. Since the introduced seawater passes through the electrodes at a very high flow velocity and pressure and is discharged to an outlet, the time for electrolysis to occur in the electrolytic cell is insufficient, resulting in low electrolysis efficiency. Also, since low-concentration sodium hypochlorite (NaOCl) in the electrolytic cell is discharged as it is, the sterilization effect on microorganisms in seawater is reduced.

FIG. 1 is a view illustrating deposition in a conventional electrolytic cell. In the case of a conventional electrolytic cell 100 illustrated in FIG. 1, electrolysis occurs as an electrolyte introduced from a lower portion of the electrolytic cell 100 is moved horizontally through the gap between electrodes, thereby producing sodium hypochlorite (NaOCl). The resulting chemical is discharged through an outlet 120. As by-products of the electrolysis, hydrogen gas and hydroxides W such as calcium hydroxide and magnesium hydroxide are generated at the cathode. These hydroxides W are discharged to the outside of the electrolytic cell 100 through the outlet 120 together with the produced sodium hypochlorite (NaOCl).

At this time, the hydroxides W are sometimes deposited in a part where the flow velocity is slow in the electrolytic cell and eventually form aggregates, thereby becoming a major cause of electrode damage and failure of the electrolytic cell 100. In particular, the space between a lower portion of an electrode assembly and a housing in the conventional electrolytic cell 100 is a dead space where electrolysis is not active. The flow velocity of the electrolyte becomes slower in this space than in an upper portion of the electrode assembly during the operation of the electrolytic cell 100, so the hydroxides W of a high specific gravity generated in the upper portion of the electrode assembly are readily deposited and form aggregates in such a slow flow velocity space. In addition, since most conventional electrolytic cells have a structure in which an inlet 110 is located at a lower portion of one side of the housing and the outlet 120 is located at an upper portion of the other side of the housing, a stagnant flow rate space where the flow rate is stagnant is formed a lower end of the outlet 120, thereby exacerbating the problem of hydroxide deposition. As described above, to remove the deposited and aggregated hydroxides W in the electrolytic cell 100, cleaning using acid is periodically performed. The removal of the hydroxides W is achieved by contacting the acid and the hydroxides W at a flow velocity above a predetermined level. However, since the same flow path is used for flow of the acid and flow of the electrolyte, the flow velocity of the acid becomes slow in the slow flow velocity space and the stagnant flow rate space, thereby reducing the acid cleaning effect. Thus, the problem of hydroxide deposition remains unsolved. In addition, deposits that are not removed by acid cleaning, such as small sand particles and mud in seawater, that do not react with the acid also accumulate.

Thus, a need exists to develop an electrolytic cell that improves the electrolysis efficiency of seawater by stabilizing and uniformly distributing the flow of seawater introduced into the electrolytic cell at high pressure and high flow velocity by a booster pump or the like, minimizes deposition of hydroxides, and enables automatic cleaning without requiring the need for a separate acid cleaning process.

The foregoing is intended merely to aid in the understanding of the background of the present disclosure, and is not intended to mean that the present disclosure falls within the purview of the related art that is already known to those skilled in the art.

DOCUMENTS OF RELATED ART (Patent document 1) Korean Utility Model Registration No. 20-0397851

SUMMARY OF THE INVENTION

Accordingly, the present disclosure has been made keeping in mind the above problems occurring in the related art, and an objective of the present disclosure is to provide a sodium hypochlorite generator for improving the internal configuration of an electrolytic cell, thereby increasing the electrolysis efficiency for a large amount of introduced seawater or brine and minimizing deposition of hydroxides.

Another objective of the present disclosure is to provide a sodium hypochlorite generator capable of automatically cleaning and removing deposits present in an electrolytic cell using circulating electrolyzed water without requiring the need for a separate process.

In order to achieve the above objectives, according to one aspect of the present disclosure, there is provided an electrolyte circulation-based sodium hypochlorite generator with an automatic electrolytic cell cleaning function, the generator including: an electrolytic cell in which brine is introduced through an inlet thereof, is electrolyzed, and is discharged through an outlet thereof; a plurality of electrodes disposed inside a housing of the electrolytic cell in a length direction of the electrolytic cell; a partition wall disposed in a direction orthogonal to the length direction in which the electrodes are disposed so as to divide the length direction, and configured to block a flow in the length direction; and a circulation port formed at a position spaced apart from the inlet and configured to allow a part of the electrolyzed brine to be discharged therethrough.

The partition wall may include a cut end formed in a portion thereof, the partition wall may include a plurality of partition walls that are disposed side by side at regular intervals in the housing, and the respective cut ends of adjacent partition walls may be alternately disposed at different positions so as not to overlap partially or entirely with each other.

The partition walls may include: an upper partition wall having a lower cut end formed in a lower portion thereof; and a lower partition wall having an upper cut end formed in an upper portion thereof, and the upper partition wall and the lower partition wall may be alternately disposed in the electrolytic cell.

A cleaning electrolyzed water inlet may be provided in the electrolytic cell, a long reverse inflow member may be connected to the cleaning electrolyzed water inlet, and the electrolyzed brine discharged through the circulation port is introduced back into the cleaning electrolyzed water inlet and then supplied into the electrolytic cell through the reverse inlet member.

The reverse inflow member may be disposed in the length direction below the electrodes, and the reverse inflow member may be supported by the partition wall and be spaced apart from a bottom of the housing.

The reverse inflow member may include: a reverse inflow hole configured to communicate with the cleaning electrolyzed water inlet; and a discharge hole configured to communicate with the reverse inflow hole to allow the cleaning electrolyzed water to be discharged therethrough.

The discharge hole may include a plurality of discharge holes that are formed at intervals in a length direction of the reverse inflow member.

The discharge hole may include a plurality of discharge holes that are formed in a lower portion of the reverse inflow member in a plurality of directions.

The circulation port may include: a first circulation port relatively close to the inlet; and a second circulation port relatively far from the inlet, and either or both of the first circulation port and the second circulation port may be opened or closed.

The present disclosure having the above-described configuration can improve the electrolysis efficiency and minimizing deposition of hydroxides by controlling a flow path of the electrolytic cell.

In addition, the present disclosure can automatically clean and remove deposits present in the electrolytic cell in real time by circulating electrolyzed water generated in the electrolytic cell without requiring the need for a separate cleaning process or complicated equipment.

In addition, the present disclosure can eliminate the need for a separate acid cleaning process, thereby enabling generation of sodium hypochlorite with stable quality.

In addition, the present disclosure can eliminate the use of separate chemicals such as hydrochloric acid for scale removal, thereby reducing the adverse effects of chlorine-based by-products, such as waste hydrochloric acid, on the environment, reducing the process load of a wastewater treatment process, and protecting the natural ecosystem.

In addition, the present disclosure can guide the flow of electrolyzed water to the location of deposits through flow path control, thereby removing deposits, which cannot be removed by chemical treatment, by physical pressure.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

Hereinafter, an embodiment of the present disclosure will be described in detail with reference to the accompanying drawings.

Figure 1:
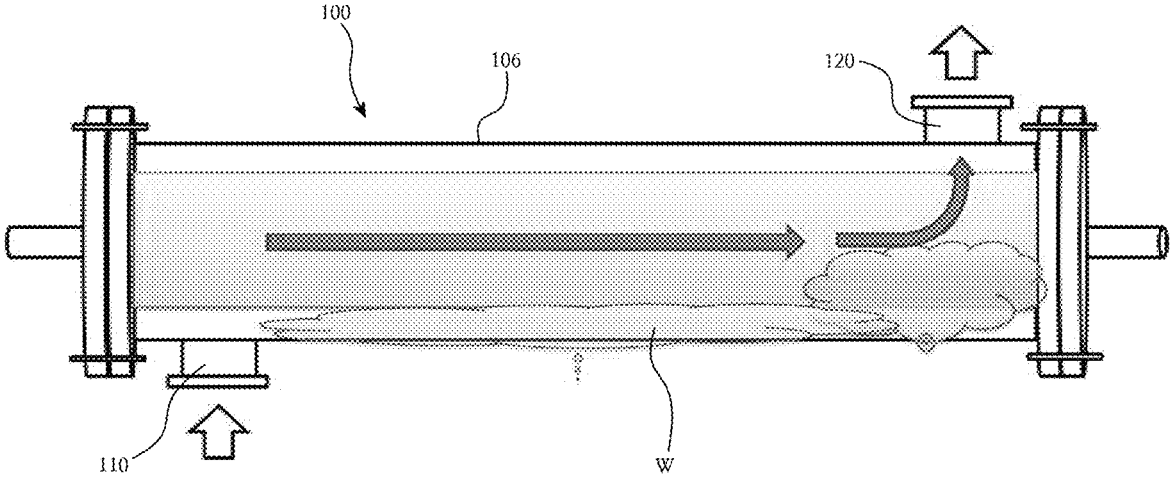
FIG. 1 is a view illustrating deposition in a conventional electrolytic cell.
Figure 2:
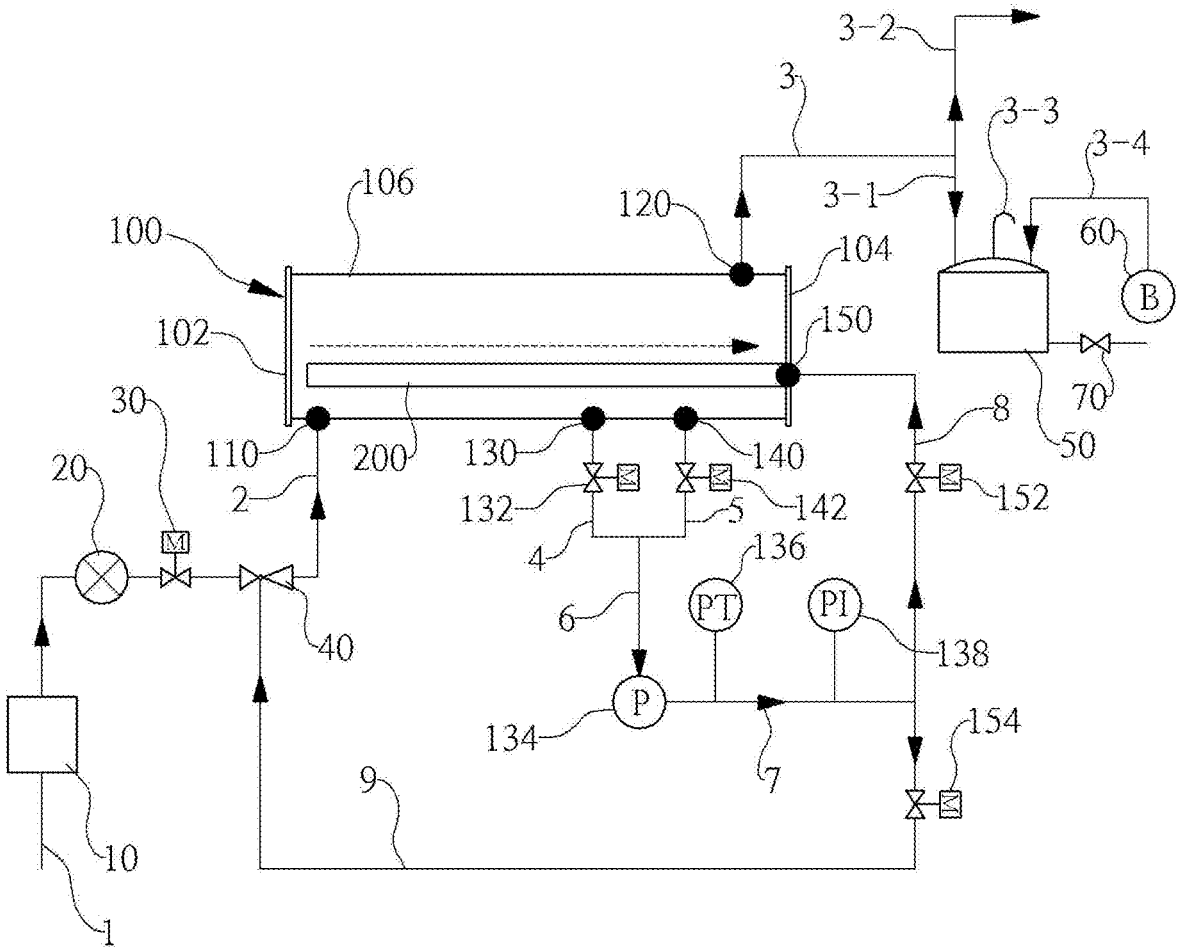
FIG. 2 is a block diagram schematically illustrating an electrolyte circulation-based sodium hypochlorite generator according to the present disclosure.

FIG. 2 is a block diagram schematically illustrating an electrolyte circulation-based sodium hypochlorite generator according to the present disclosure. Referring to FIG. 2, seawater or brine is introduced through a brine inlet pipe 1, is passed sequentially through a brine filter 10, an inlet flow meter 20, an inlet valve 30, and a venturi 40, and is introduced into an inlet 110 of an electrolytic cell 100 through an electrolytic cell inlet pipe 2. The introduced brine is electrolyzed according to the principle of [Reaction Formula 1] in the process of flowing inside a housing 106 in a length direction of the electrolytic cell 100 (in the direction of the arrow from left to right in FIG. 2), thereby generating sodium hypochlorite (NaOCl). After that, the brine is discharged to an electrolytic cell outlet pipe 3 through an outlet 120.

$$NaCl+H_20+2e^{-}\rightarrow NaOCl+H_2 \quad \text{[Reaction Formula 1]}$$

The generated sodium hypochlorite (NaOCl) is introduced into a sodium hypochlorite storage tank 50 through a sodium hypochlorite tank inlet pipe 3-1 and then stored. The stored sodium hypochlorite (NaOCl) is provided to a required position by opening and closing a sodium hypochlorite outlet valve 70. Reference numerals 3-2, 3-3, 3-4, and 60 denote a hydrogen discharge pipe, a vent, a blowing pipe, and a blower, respectively.

In this process, an electrolyzed water, that is, a solution containing the produced sodium hypochlorite (NaOCl), is partially discharged to circulation ports 130 and 140 located at a rear end of the electrolytic cell 100. At this time, the circulation ports 130 and 140 may be divided into a first circulation port 130 relatively close to the inlet 110 and a second circulation port 140 relatively far from the inlet 110 along the length direction. The number of the circulations ports 130 and 140 may be increased to three or more.

According to an embodiment, only the first circulation port 130 is normally opened while the second circulation port 140 is closed so that only the electrolyzed water located at the first circulation port 130 is used for circulation and/or cleaning. In order to prepare for the case where deposits at the position between the first circulation port 130 and the second circulation port 140 are not cleaned, the second circulation port 140 is also periodically opened together or alone so that the electrolyzed water is used for circulation and/or cleaning.

For example, during normal operation, only the first circulation port 130 is opened to allow a circulating electrolyzed water to be circulated through a circulating electrolyzed water pipe 9 toward the inlet 110 of the electrolytic cell 100, thereby controlling temperature. During normal operation, intermittently or periodically, the first circulation port 130 is closed while only the second circulation port 140 is opened, or the first circulation port 130 and the second circulation port 140 are simultaneously opened so that deposits and the like are discharged to the second circulation port 140. In addition, a large amount of circulating electrolyzed water is allowed to flow toward a cleaning electrolyzed water pipe 8 and used for cleaning. When the second circulation port 140 is opened, as the circulating electrolyzed water is discharged to the second circulation port 140, deposits between the first circulation port 130 and the second circulation port 140, that is, at the rear end of the electrolytic cell 100, are removed chemically and physically, and no scale is formed. After the cleaning process is finished, the second circulation port 140 is closed again while only the first circulation port 130 is opened, or conversely, the first circulation port 130 is closed while only the second circulation port 140 is opened so that only a small amount of electrolyzed water is circulated toward the circulating electrolyzed water pipe 9.

In addition, when any one of the first and second circulation ports 130 and 140 is closed by deposits, the remaining one is used instead. Alternatively, using the fact that the pH of the electrolyzed water changes toward the rear end of the electrolytic cell 100, the first and second circulation ports 130 and 140 are selectively used so that the electrolyzed water of an appropriate pH is selected and used for circulation or cleaning.

The electrolyzed water from the first and second circulation ports 130 and 140 are discharged to first and second electrolyzed water circulation ports 4 and 5 by opening first and second circulation valves 132 and 142, respectively. The discharged electrolyzed water is supplied to the cleaning electrolyzed water pipe 8 by an electrolyzed water circulation pump 134 along an electrolyzed water circulation pump inlet pipe 6 and an electrolyzed water circulation pump outlet pipe 7. It is preferable that an electrolyzed water pipe pressure gauge 136 and an electrolyzed water pipe pressure sensor 138 are disposed near the electrolyzed water circulation pump outlet pipe 7.

When the cleaning electrolyzed water pipe 8 is opened by an opening and closing operation of an electrolytic cell cleaning valve 152, the supplied electrolyzed water is introduced into the electrolytic cell 100 through a cleaning electrolyzed water inlet 150 of the electrolytic cell 100. The introduced electrolyzed water then flows in a direction opposite to a normal flow direction of the electrolyzed water along a long reverse inflow member 200 and is evenly sprayed toward a lower space inside the housing 106.

The electrolyzed water circulation pump outlet pipe 7 is also connected to the circulating electrolyzed water pipe 9. When the electrolyzed water circulation valve 154 is opened, the electrolyzed water is circulated through the circulating electrolyzed water pipe 9 and is combined with brine introduced through the brine inlet pipe 1. At this time, it is preferable that the electrolyzed water passes through the venturi 40. The venturi 40 forms a negative pressure through internal pressure reduction so that the circulating electrolyzed water is efficiently injected and mixed from the circulating electrolyzed water pipe 9. Seawater or brine introduced from the brine inlet pipe 1 is introduced at a relatively high pressure. Thus, the use of the venturi 40 enables that even when a pump for pumping the circulating electrolyzed water circulating through the circulating electrolyzed water pipe 9 is a low-pressure pump or only a small load is applied to the pump, the circulating electrolyzed water is efficiently injected without undergoing injection and mixing problems caused by a pressure difference.

The relatively high-temperature circulating electrolyzed water is combined with the relatively low-temperature brine, so the average temperature of the electrolyzed water introduced into the electrolytic cell 100 is increased. In the case of electrolysis of seawater, unlike electrolysis of water, a considerably large amount of water is introduced and treated per hour. Since electrodes of the electrolytic cell 100 tend to be damaged at a low temperature equal to or less than 12° C. to 15° C., it is necessary to increase the temperature of introduced seawater to at least close to this range. However, pre-heating a considerable amount of introduced seawater with steam is possible only around power plants with a lot of surplus energy, and heating using separate electricity consumes more energy compared to electrolysis.

Due to this problem, seawater electrolysis is mostly performed by introducing low-temperature seawater as it is into the electrolytic cell 100 in spite of the problem of electrode damage. However, since the temperature of the introduced seawater becomes close to 0° C. especially in the winter season, the electrodes of the electrolytic cell 100 are rapidly damaged. As a result, the electrolysis efficiency is lowered, and the life of the electrodes do not exceed 1 to 2 years. In the present disclosure, the above problem can be solved in such a manner that the circulating electrolyzed water at the rear end of the electrolytic cell 100, which is in a state in which the temperature thereof has increased by about 15° C. through electrolysis compared to before electrolysis, is partially discharged and circulated to be mixed with the introduced seawater. This allows the temperature of the seawater to be increased by about 6° C. to 8° C. without requiring additional energy input, thereby minimizing the influence of temperature on the electrodes. Also, by controlling the flow rate of the circulating electrolyzed water, the temperature of the introduced seawater is increased and the overall temperature of the electrolytic cell 100 is stably controlled. Consequently, the electrodes are prevented from being damaged and thus the life thereof is increased by more than ten times, energy is significantly reduced, and the electrolysis efficiency is improved.

Figure 3:
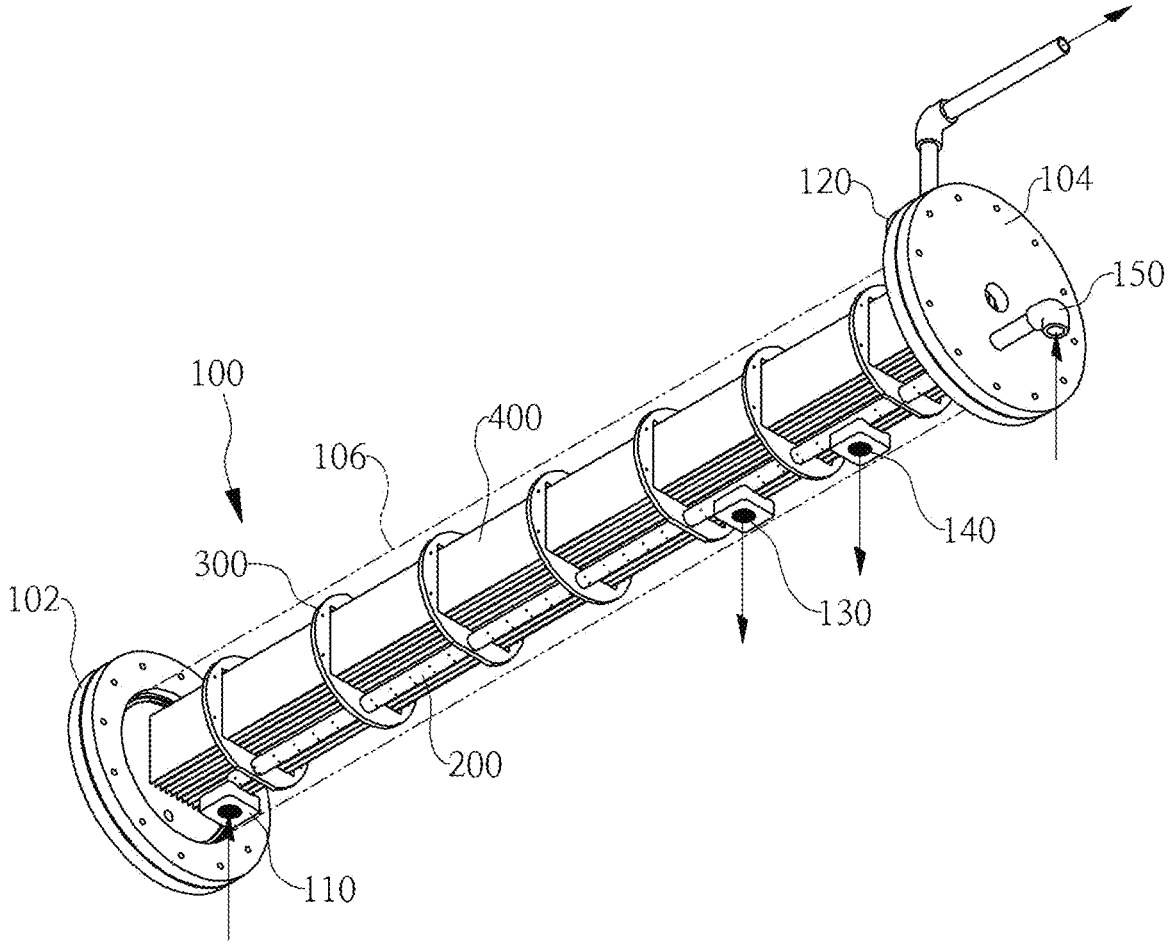
FIG. 3 is a view illustrating an electrolytic cell according to the present disclosure.

FIG. 3 is a view illustrating the electrolytic cell 100 according to the present disclosure. Referring to FIG. 3, the electrolytic cell 100 includes the long housing 106 disposed in the length direction, and front and rear flanges 102 and 104. A plurality of electrodes 400 are disposed in an inner space of the electrolytic cell 100 in the length direction.

The inlet 110 is formed at a lower side of a front end of the electrolytic cell 100. Brine before electrolysis is introduced into the inlet 110, and undergoes an electrolysis process in the electrodes 400 while flowing in the length direction. Sodium hypochlorite (NaOCl) resulting from electrolysis is discharged to the electrolytic cell outlet pipe 3 through the outlet 120 formed at an upper side of the rear end of the electrolytic cell 100.

A plurality of partition walls 300 are disposed side by side at regular intervals in the housing 160. The partition walls 300 are coupled to the long electrodes 400 in directions orthogonal to the length direction in which the electrodes 400 are disposed so as to divide the length direction. The partition walls 300 support the electrodes 400 or are supported by the electrodes 400, and serve to control a flow path of electrolyzed water.

The first circulation port 130 and the second circulation port 140 are formed at a lower side of the rear end of the electrolytic cell 100 so that the electrolyzed water, that is, the electrolyzed water containing the generated sodium hypochlorite (NaOCl) is discharged downward through the first circulation port 130 and the second circulation port 140.

The cleaning electrolyzed water inlet 150 is formed on the rear flange 104 of the electrolytic cell 100. The electrolyzed water discharged through the first circulation port 130 and the second circulation port 140 is circulated and introduced back into the electrolytic cell 100 through the cleaning electrolyzed water inlet 150. In some cases, the cleaning electrolyzed water inlet 150 may be formed at a lower side, an upper side, or a lateral side of a rear end of the housing 106 rather than on the flange 104.

The reverse inflow member 200 coupled to the rear flange 104 is formed in a long pipe shape extending in the length direction from the rear flange 104 to the front flange 102. The reverse inflow member 200 is disposed below the electrodes 400 parallel to the electrodes 400, and is spaced apart from the bottom of the housing 106. The reverse inflow member 200 passes through a plurality of through-holes 302 (see FIG. 4) formed in the plurality of partition walls 300 and is supported by the partition walls 300.

Figure 4:
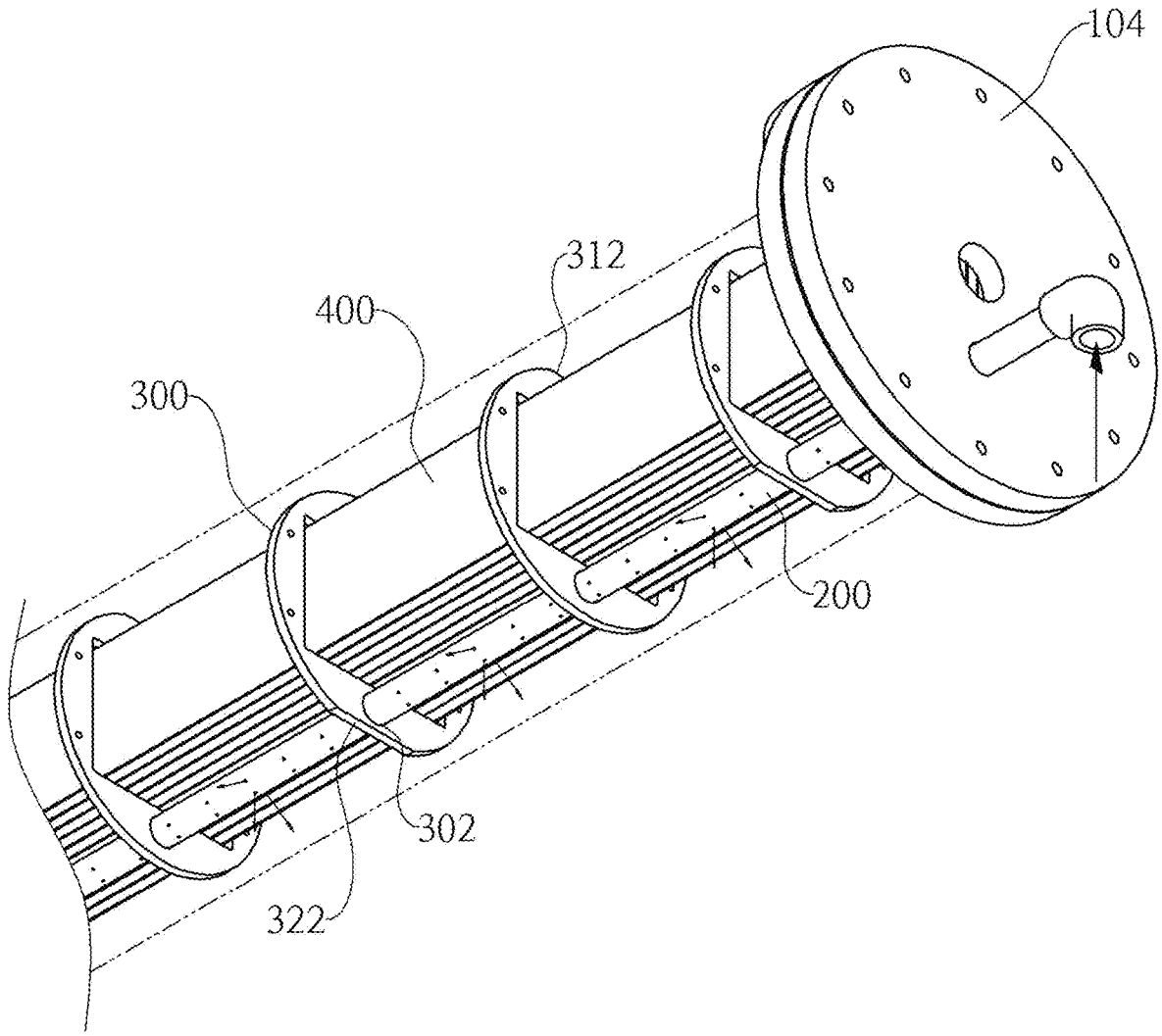
FIG. 4 is an enlarged view illustrating the electrolytic cell according to the present disclosure.

FIG. 4 is an enlarged view illustrating the electrolytic cell 100 according to the present disclosure. Referring to FIG. 4, a cleaning electrolyzed water (cleaning water) containing sodium hypochlorite (NaOCl) resulting from electrolysis in the electrodes 400 is circulated and introduced into the cleaning electrolyzed water inlet 150, and then supplied into the electrolytic cell 100 along the reverse inflow member 200. The cleaning electrolyzed water flows in the reverse direction from the rear end toward the front end of the electrolytic cell 100 along the reverse inflow member 200, moves to near the front end of the electrolytic cell 100, and is sprayed toward the lower space inside the housing 106.

The sprayed cleaning electrolyzed water removes and cleans deposits present in the lower space through a neutralization reaction. This eliminates the need for a separate acid cleaning process unlike the related art.

Figure 5:
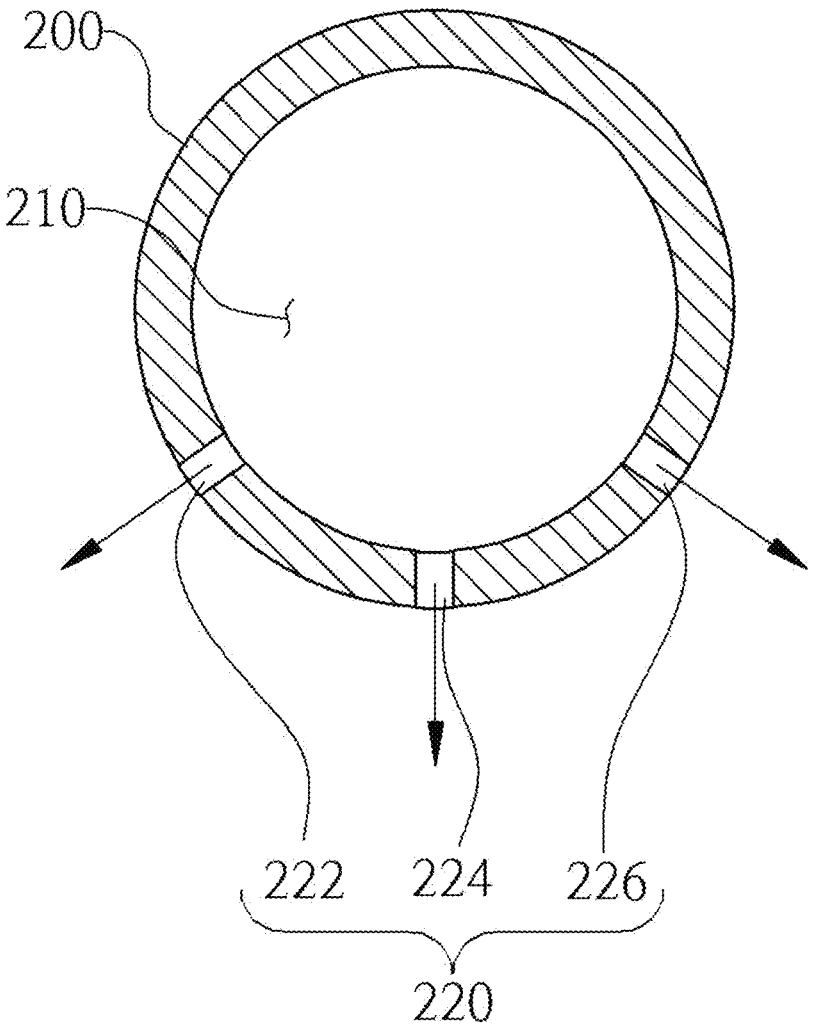
FIG. 5 is a cross-sectional view illustrating a reverse inflow member illustrated in FIG. 4.

FIG. 5 is a cross-sectional view illustrating the reverse inflow member 200 illustrated in FIG. 4. Referring to FIG. 5, the reverse inflow member 200 may be a circular pipe. The reverse inflow member 200 has a long reverse inflow hole 210 formed through the inside thereof and communicating with the cleaning electrolyzed water inlet 150, and a plurality of discharge holes 220 formed in a lower portion thereof at regular intervals and communicating with the reverse inflow hole 210 to allow cleaning electrolyzed water to be discharged therethrough.

The plurality of discharge holes 220 form a group, and a plurality of groups are formed at regular intervals in a length direction of the reverse inflow member 200.

Each group of the discharge holes 220 may include a vertical discharge hole 224 oriented directly downward on a cross-section orthogonal to the length direction, and inclined discharge holes 222 and 226 oriented obliquely in opposite directions.

The cleaning electrolyzed water flowing inside the reverse inflow member 200 is discharged downward through the discharge holes 220. That is, the cleaning electrolyzed water is sprayed into a wide space through the vertical discharge hole 224 and the inclined discharge holes 222 and 226 in various directions, thereby cleaning deposits present in a wide region.

Figure 6:
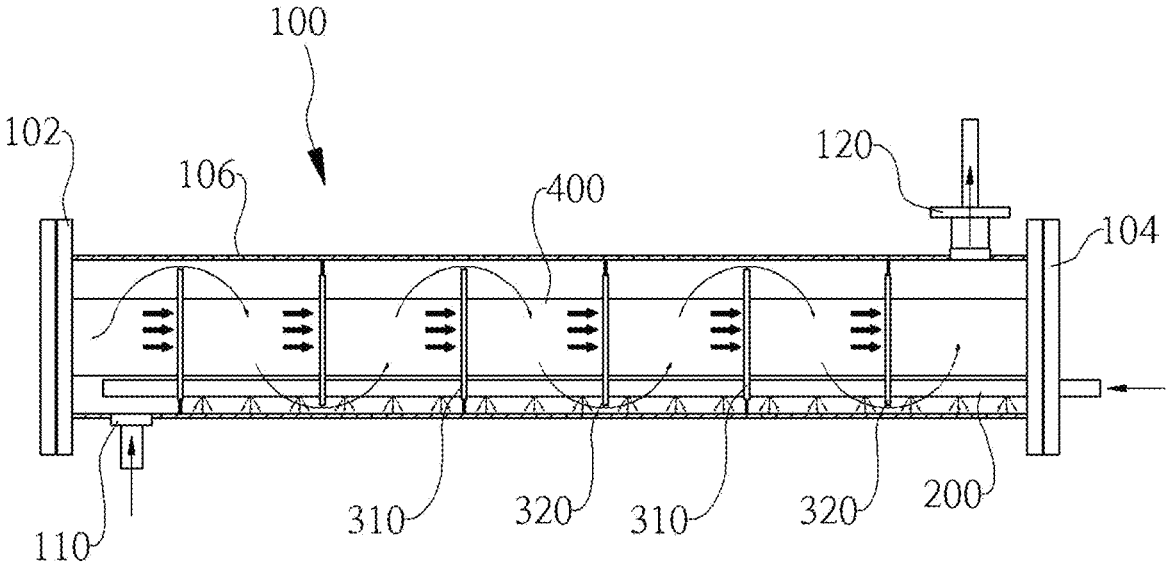
FIG. 6 is a longitudinal sectional view illustrating the electrolytic cell according to the present disclosure.
Figure 7:
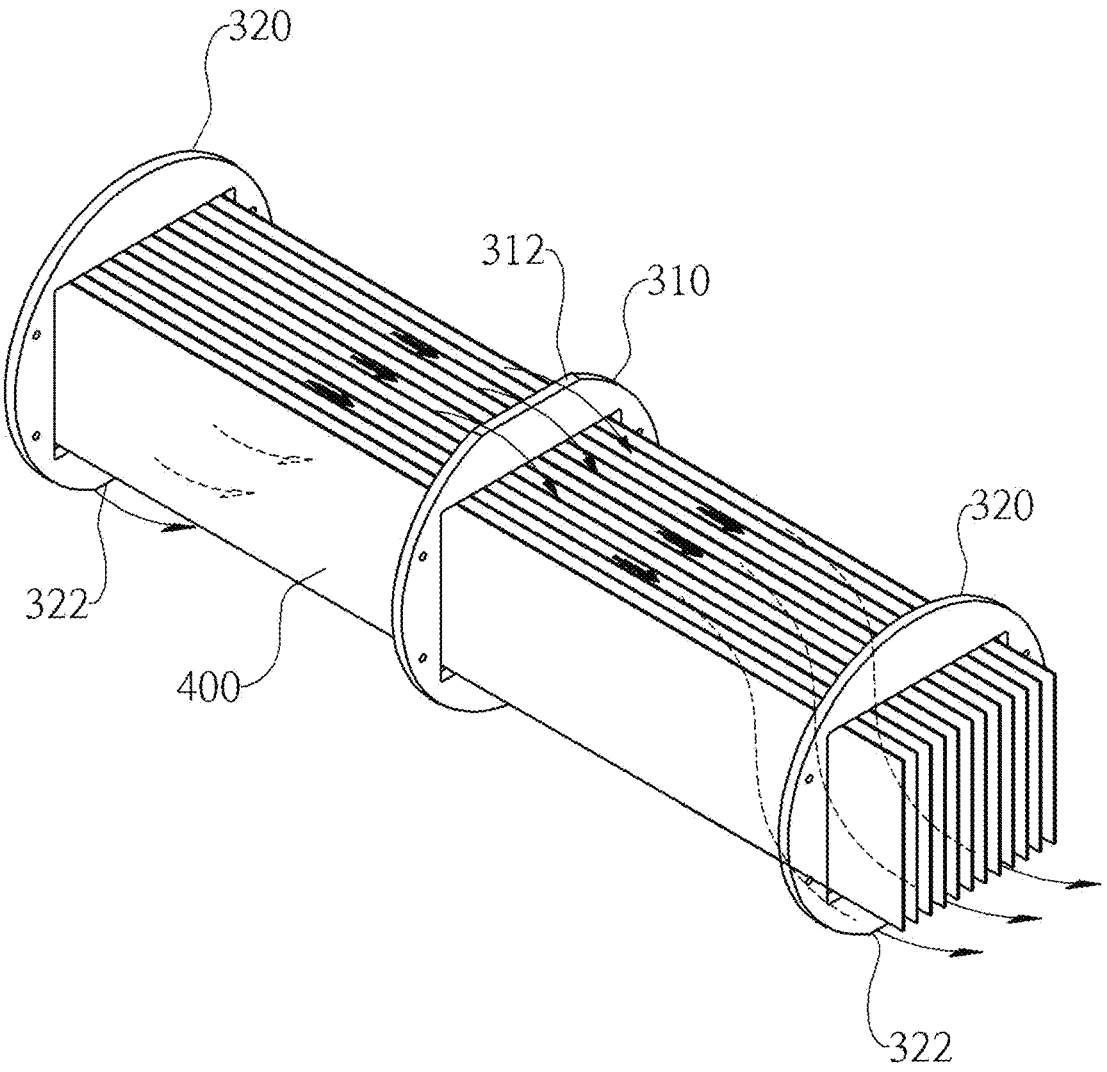
FIG. 7 is a view illustrating an internal flow of the electrolytic cell according to the present disclosure.

FIG. 6 is a longitudinal sectional view illustrating the electrolytic cell 100 according to the present disclosure, and FIG. 7 is a view illustrating an internal flow of the electrolytic cell 100 according to the present disclosure. Referring to FIGS. 6 and 7, the plurality of partition walls 300 are coupled to the electrodes 400 disposed in the length direction of the electrolytic cell 100 in directions orthogonal to the length direction.

At this time, a flow path of brine introduced and flowing through the inlet 110 is made more complicated and the contact time and contact area with the electrodes 400 are increased so that the electrolysis efficiency is increased.

To this end, the partition walls 300 block the brine from flowing straight (in the length direction), that is, allow the brine to flow up and down. The partition walls 300 include a lower partition wall 310 having an upper cut end 312 and an upper partition wall 320 having a lower cut end 322. The lower partition wall 310 and the upper partition wall 320 are alternately disposed. With this structure, openings are alternately formed above the upper cut end 312 and the lower cut end 322, that is, between the upper and lower cut ends 312 and the inner circumferential surface of the housing 106.

Thus, as illustrated in FIGS. 6 and 7, an open serpentine flow path is formed by the alternate openings, so the brine flows up and down in a serpentine manner. The flow path is extended as the brine continues to flow successively in this manner, so the contact time and contact area with the electrodes 400 is increased, thereby increasing the electrolysis efficiency.

The partition walls 300 may be formed in a circular plate shape so that the partition walls 300 are in contact with the inner circumferential surface of the housing 106 or have a minimum gap with the inner circumferential surface of the housing 106. For example, the partition walls 300 may have a substantially semicircular shape that is formed by cutting a part of a circular plate. In this case, an opening corresponding to the shape of the cut part of the circular plate is formed above the upper cut end 312 of the lower partition wall 310. Similarly, an opening corresponding to the shape of the cut part of the circular plate is formed below the lower cut end 322 of the upper partition wall 320.

As the brine flows up and down in a serpentine manner, electrolysis takes place. The brine passing through the opening below the lower cut end 322 of one upper partition wall 320 flows up while flowing in the length direction, is electrolyzed while passing between the electrodes 400, and passes through the opening above the upper cut end 312 of an adjacent lower partition wall 310. The brine passing through the opening above the upper cut end 312 flows down again, is electrolyzed while passing between the electrodes 400, and is guided to the opening below the lower cut end 322 of an adjacent upper partition wall 320.

That is, seawater, brine, and an electrolyte flow up and down through a serpentine flow path. Although it has been described that the cut ends 312 and 322 are alternately disposed in the vertical direction, the present disclosure is not limited thereto, and the cut ends 312 and 322 may alternately disposed in a direction selected from the vertical and horizontal directions so as not to overlap with each other.

Since electrolysis occurs as the electrolyte passes between an anode and a cathode of the electrodes 400, it is necessary to increase the contact area and contact time between the electrolyte and the electrodes 400 in order to increase the electrolysis efficiency. Thus, the serpentine flow path as described above enables an increase in the contact area and contact time between the electrolyte and the electrodes 400, resulting in higher electrolysis efficiency compared to a horizontal flow path of a conventional electrolytic cell.

In addition, a slow flow velocity space formed between a lower portion of an electrode assembly and a housing and a stagnant flow rate space formed at a lower end of an outlet, which are the problems of the conventional electrolytic cell, are eliminated, thereby minimizing deposition of hydroxides generated during electrolysis. This effect is further maximized when the above-described reverse inflow member 200 is applied together.

In addition, since the inner space of the electrolytic cell 100 is partitioned into a plurality of upflow and downflow spaces by the partition walls 300 and the electrolyte sequentially passes through each space, a reduction in flow velocity is minimized, thereby facilitating efficient discharge of hydroxides.

Although a preferred embodiment of the present disclosure has been described for illustrative purposes, those skilled in the art will appreciate that various modifications, additions, and substitutions are possible, without departing from the scope and spirit of the present disclosure as disclosed in the accompanying claims.

What is claimed is:

1. An electrolyte circulation-based sodium hypochlorite generator with an automatic electrolytic cell cleaning function, the generator comprising:

an electrolytic cell in which brine is introduced through an inlet thereof, is electrolyzed, and is discharged through an outlet thereof;

a plurality of electrodes disposed inside a housing of the electrolytic cell in a length direction of the electrolytic cell;

a partition wall disposed in a direction orthogonal to the length direction in which the plurality of electrodes are disposed, and configured to block a flow in the length direction; and a circulation port disposed at a position spaced apart from the inlet and configured to allow a part of the electrolyzed brine to be discharged therethrough, wherein the partition wall comprises a cut end defined in a portion thereof, wherein the partition wall comprises a plurality of partition walls disposed side by side at regular intervals in the housing, and wherein the respective cut ends of adjacent partition walls are alternately disposed at different positions without partial or complete overlap.

2. The generator of claim 1, wherein the plurality of partition walls comprises:

an upper partition wall having a lower cut end defined in a lower portion thereof; and a lower partition wall having an upper cut end defined in an upper portion thereof, and wherein the upper partition wall and the lower partition wall are alternately disposed in the electrolytic cell.

3. The generator of claim 1, wherein the circulation port comprises:

a first circulation port disposed closer to the inlet; and a second circulation port disposed farther from the inlet than the first circulation port, and wherein at least one of the first circulation port and the second circulation port is opened or closed.

4. An electrolyte circulation-based sodium hypochlorite generator with an automatic electrolytic cell cleaning function, the generator comprising:

an electrolytic cell in which brine is introduced through an inlet thereof, is electrolyzed, and is discharged through an outlet thereof;

a plurality of electrodes disposed inside a housing of the electrolytic cell in a length direction of the electrolytic cell;

a partition wall disposed in a direction orthogonal to the length direction in which the plurality of electrodes are disposed, and configured to block a flow in the length direction;

a circulation port disposed at a position spaced apart from the inlet and configured to allow a part of the electrolyzed brine to be discharged therethrough;

a cleaning electrolyzed water inlet disposed in the electrolytic cell; and a reverse inflow member is connected to the cleaning electrolyzed water inlet, wherein the electrolyzed brine discharged through the circulation port is introduced back into the cleaning electrolyzed water inlet and then supplied into the electrolytic cell through the reverse inflow member.

5. The generator of claim 4, wherein the reverse inflow member is disposed in the length direction below the plurality of electrodes, and wherein the reverse inflow member is supported by the partition wall and is spaced apart from a bottom of the housing.

6. The generator of claim 4, wherein the reverse inflow member comprises:

a reverse inflow hole configured to communicate with the cleaning electrolyzed water inlet; and a discharge hole configured to communicate with the reverse inflow hole to allow cleaning electrolyzed water to be discharged therethrough.

7. The generator of claim 6, wherein the discharge hole comprises a plurality of discharge holes that are defined at intervals in a length direction of the reverse inflow member.

8. The generator of claim 6, wherein the discharge hole comprises a plurality of discharge holes defined in a lower portion of the reverse inflow member in a plurality of directions.

* * * * *